US009696017B2

(12) United States Patent
Allen

(10) Patent No.: US 9,696,017 B2
(45) Date of Patent: Jul. 4, 2017

(54) LIGHTING SYSTEM

(71) Applicant: Lisa Allen, Edmonds, WA (US)

(72) Inventor: Lisa Allen, Edmonds, WA (US)

( * ) Notice: Subject to any disclaimer, the term of this patent is extended or adjusted under 35 U.S.C. 154(b) by 18 days.

(21) Appl. No.: 14/796,323

(22) Filed: Jul. 10, 2015

(65) Prior Publication Data

US 2017/0009967 A1 Jan. 12, 2017

(51) Int. Cl.

| | |
|---|---|
| ***F21V 21/088*** | (2006.01) |
| ***F21V 23/04*** | (2006.01) |
| ***F21S 9/02*** | (2006.01) |
| ***A45C 15/06*** | (2006.01) |

(52) U.S. Cl.

CPC ..... *F21V 21/088* (2013.01); *A45C 15/06* (2013.01); *F21S 9/02* (2013.01); *F21V 23/04* (2013.01)

(58) Field of Classification Search

CPC ..... F21V 21/088; F21V 23/04; F21S 9/02; F21Y 2101/02; A45C 15/06

See application file for complete search history.

(56) References Cited

U.S. PATENT DOCUMENTS

| | | | | |
|---|---|---|---|---|
| 2,534,179 | A | 12/1950 | Peterson et al. | |
| 2,774,860 | A | 12/1956 | Prebol et al. | |
| 4,954,934 | A | 9/1990 | Kidder et al. | |
| 5,424,926 | A | 6/1995 | Myers | |
| 6,099,140 | A | 8/2000 | Norris | |
| 6,508,568 | B1 | 1/2003 | Blue-Recio | |
| D563,002 | S | 2/2008 | Irizarry | |
| 2011/0170282 | A1* | 7/2011 | Munoz | A45C 15/06 362/156 |

* cited by examiner

*Primary Examiner* — Stephen F Husar

(57) ABSTRACT

A lighting system includes a bag that has an outer wall and the outer wall has an inside surface. A lighting unit is removably attached to the bag and the lighting unit is positioned on the inside surface of the outer wall. The lighting unit is selectively actuatable to emit light downwardly in the bag with respect to the lighting unit and laterally in the bag with respect to the lighting unit. Thus, the lighting unit illuminates an interior of the bag thereby facilitating contents of the bag to be found in darkness.

9 Claims, 5 Drawing Sheets

LIGHTING SYSTEM

BACKGROUND OF THE DISCLOSURE

Field of the Disclosure

The disclosure relates to lighting devices and more particularly pertains to a new lighting device for illuminating an interior of a bag or the like.

SUMMARY OF THE DISCLOSURE

An embodiment of the disclosure meets the needs presented above by generally comprising a bag that has an outer wall and the outer wall has an inside surface. A lighting unit is removably attached to the bag and the lighting unit is positioned on the inside surface of the outer wall. The lighting unit is selectively actuatable to emit light downwardly in the bag with respect to the lighting unit and laterally in the bag with respect to the lighting unit. Thus, the lighting unit illuminates an interior of the bag thereby facilitating contents of the bag to be found in darkness.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
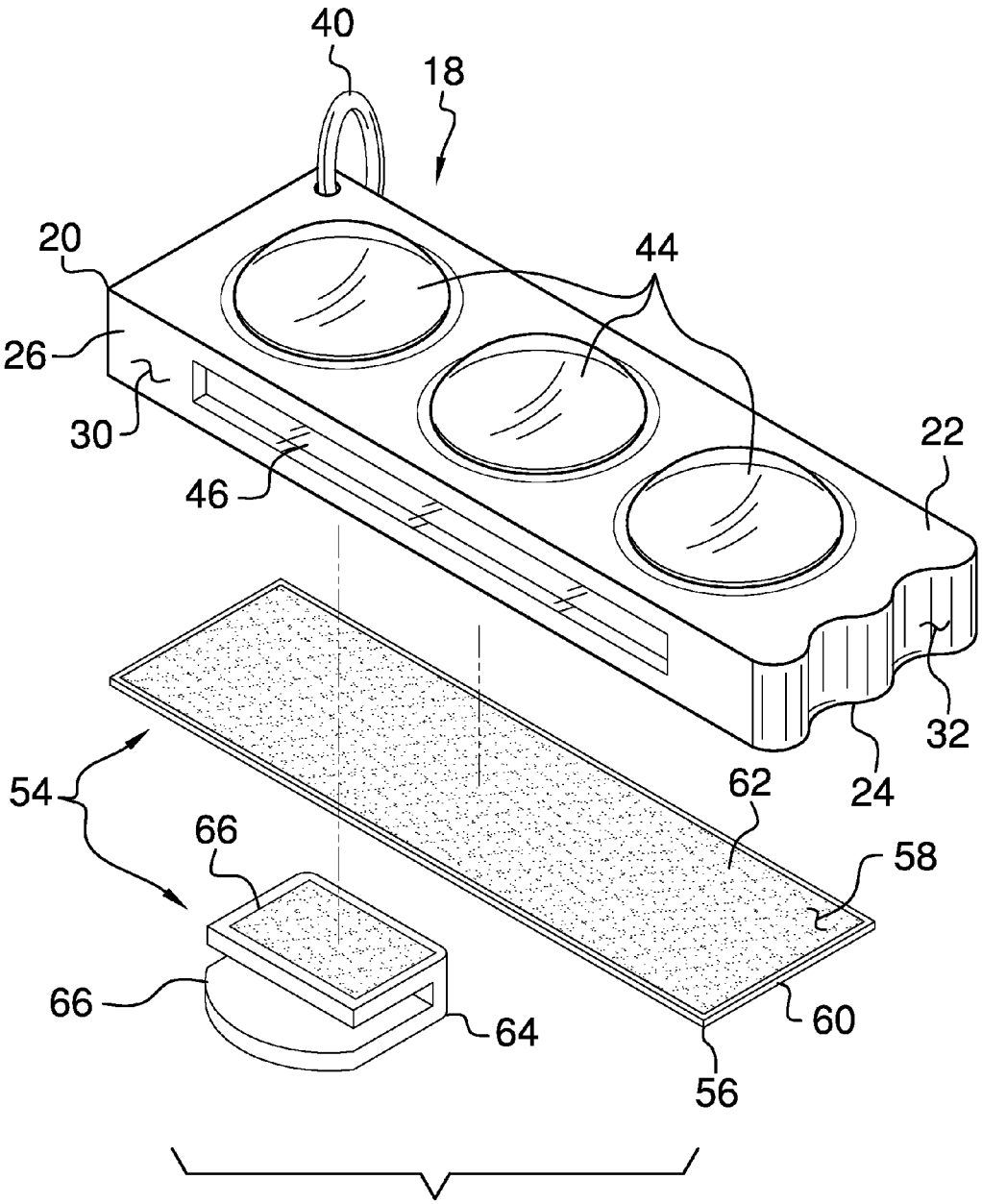
FIG. 1 is an exploded perspective view of a lighting system according to an embodiment of the disclosure.
Figure 2:
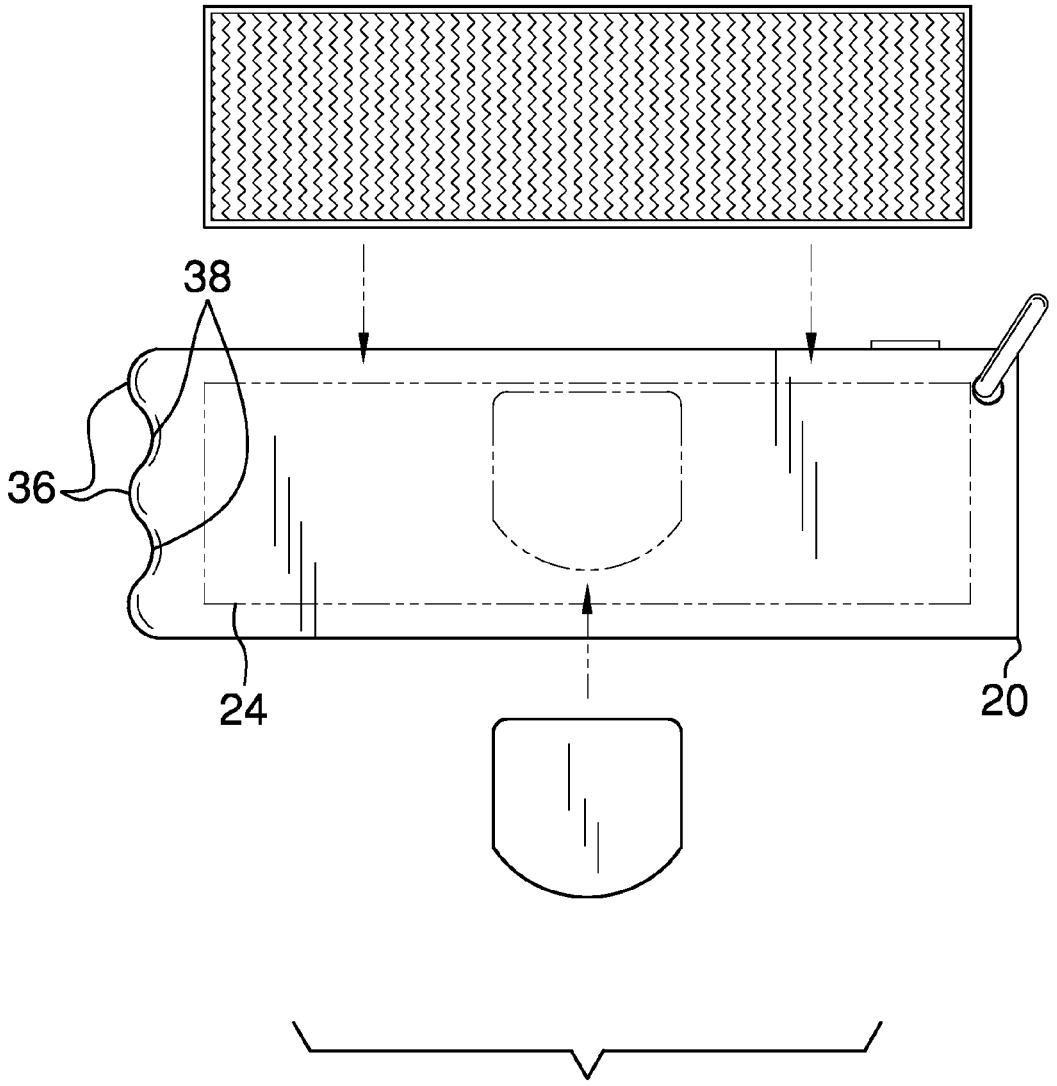
FIG. 2 is a back view of an embodiment of the disclosure.
Figure 3:
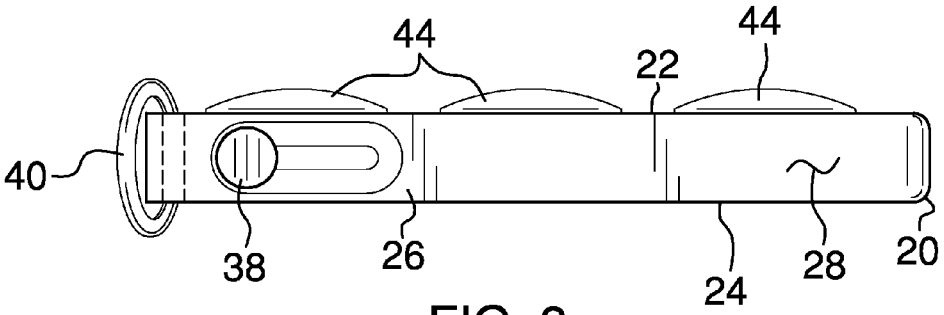
FIG. 3 is a top view of an embodiment of the disclosure.
Figure 4:
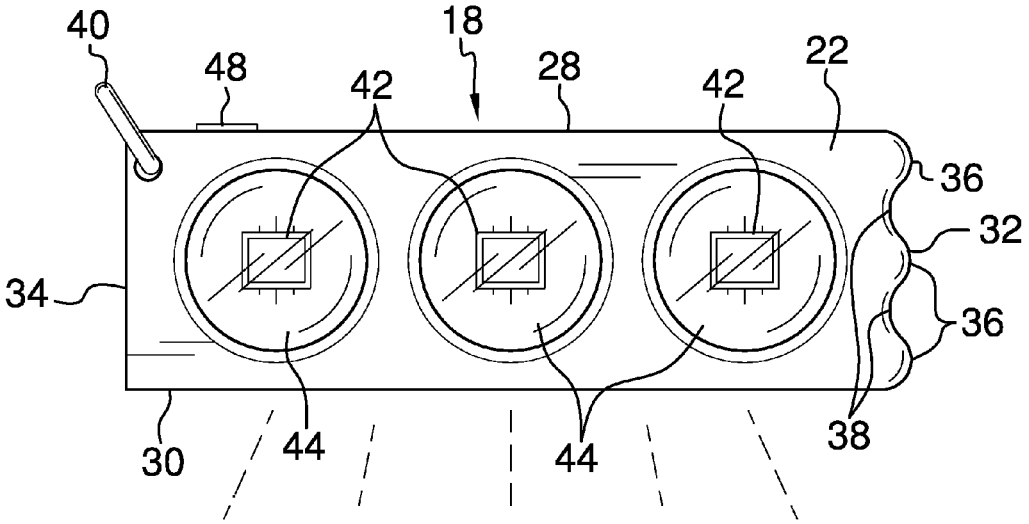
FIG. 4 is a front view of an embodiment of the disclosure.
Figure 5:
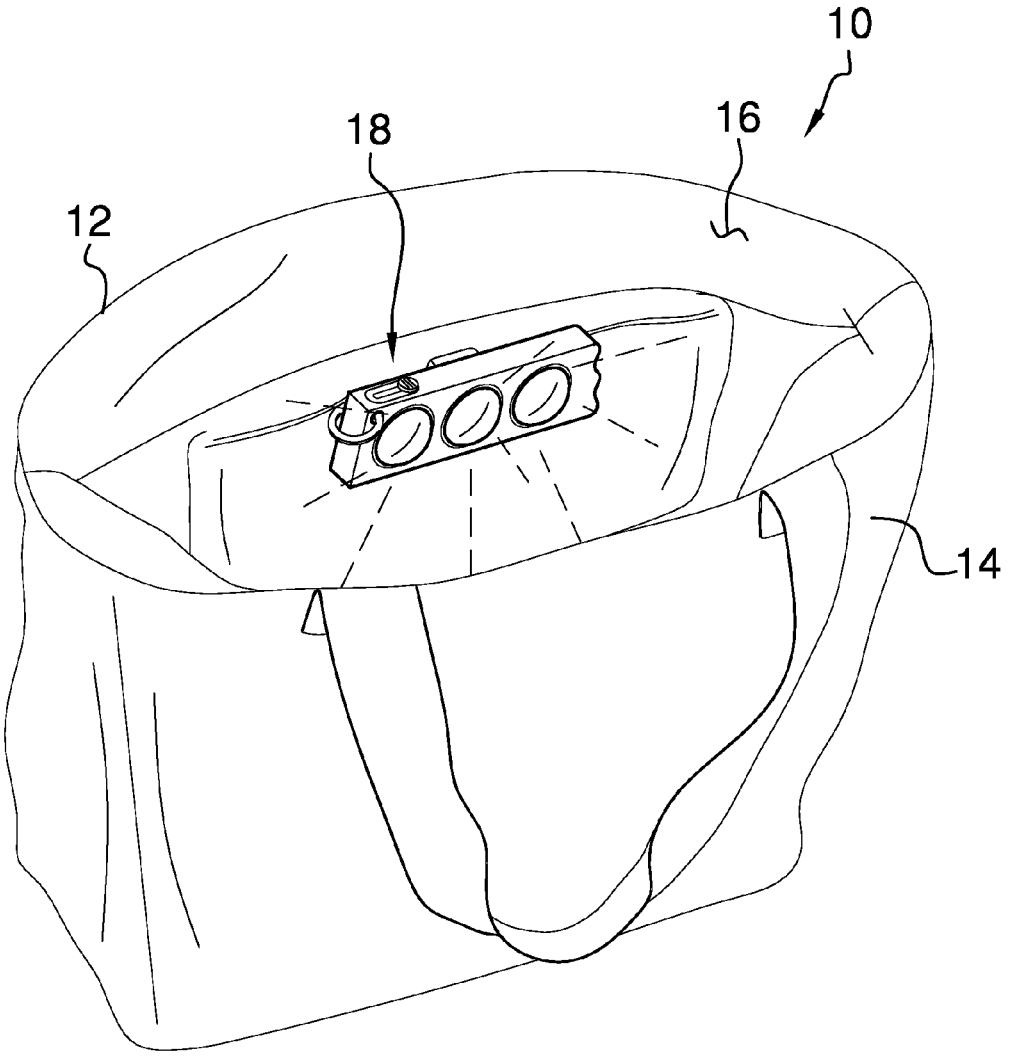
FIG. 5 is an in-use view of an embodiment of the disclosure.
Figure 6:
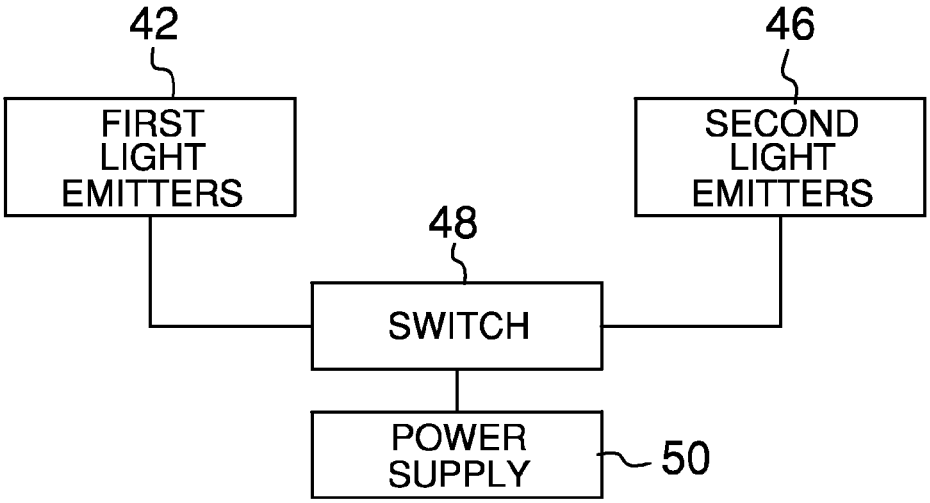
FIG. 6 is a schematic view of an embodiment of the disclosure.

With reference now to the drawings, and in particular to FIGS. 1 through 6 thereof, a new lighting device embodying the principles and concepts of an embodiment of the disclosure and generally designated by the reference numeral 10 will be described.

As best illustrated in FIGS. 1 through 6, the lighting system 10 generally comprises a bag 12 that has an outer wall 14. The outer wall 14 has an inside surface 16 and the bag 12 may comprise a purse or the like. A lighting unit 18 is removably attached to the bag 12 and the lighting unit 18 is positioned on the inside surface 16 of the outer wall 14. The lighting unit 18 is selectively actuatable to emit light downwardly in the bag 12 and laterally in the bag 12 such that the lighting unit 18 illuminates an interior of the bag 12. Thus, the lighting unit 18 facilitates contents of the bag 12 to be found in darkness.

The lighting unit 18 comprises a housing 20 that has a front side 22, a back side 24 and a peripheral side 26 extending between the front side 22 and the back side 24. The peripheral side 26 has a top surface 28, a bottom surface 30, a first lateral surface 32 and a second lateral surface 34. The first lateral surface 32 comprises an alternating sequence of hills 36 and valleys 38. The hills 36 and valleys 38 are distributed between the top surface 28 and the bottom surface 30 such that the hills 36 and valleys 38 enhance a grip of the housing 20. A key ring 40 is attached to the housing 20 and the key ring 40 is positioned at an intersection of the top surface 28 and the first lateral surface 32.

A plurality of first light emitters 42 is provided and each of the first light emitters 42 is attached to the housing 20. Each of the first light emitters 42 is spaced apart from each other and distributed along the front side 22. Each of the first light emitters 42 emits light laterally within the bag 12 with respect to the housing 20 and each of the first light emitters 42 may comprise an LED or the like. A plurality of lenses 44 is provided and each of the lenses 44 is attached to the front side 22. Each of the lenses 44 is aligned with an associated one of the first light emitters 42 and each of the lenses 44 is substantially convex with respect to the front side 22. Thus, each of the lenses 44 increases a distribution of the light emitted by each of the first light emitters 42.

A second light emitter 46 is provided and the second light emitter 46 is attached to the housing 20. The second light emitter 46 is positioned to extend along the bottom surface 30 such that the second light emitter 46 emits light downwardly into the bag 12. The second light emitter 46 may comprise an LED or the like.

A switch 48 is coupled to the housing 20 and the switch 48 is positioned on the top surface 28. The switch 48 is electrically coupled to each of the first light emitters 42 and the second light emitter 46. Thus, the switch 48 selectively actuates and de-actuates each of the first light emitters 42 and the second light emitter 46. The switch 48 may be a slide switch or the like and the switch 48 may be slid between and on position and an off position. A power supply 50 is positioned within the housing 20 and the power supply 50 is electrically coupled to the switch 48. The power supply 50 comprises at least one battery 52.

An attachment 54 is attached to the housing 20 and the attachment 54 is positioned on the back side 24. The attachment 54 engages the inside surface 16 of the outer wall 14 such that the housing 20 is removably retained on the inside surface 16.

The attachment 54 may comprise a strip 56 that has a front surface 58 and a back surface 60. The front surface 58 may have an adhesive layer 62 coupled thereto. The adhesive layer 62 adhesively engages the back side 24 of the housing 20 thereby retaining the strip 56 on the housing 20. The back surface 60 may comprise a hook and loop fastener that engages the inside surface 16 of the bag 12 such that the housing 20 is removably retained on the outer wall 14 of the bag 12. The attachment 54 may alternatively comprise a clip 64 and the clip 64 may comprise a pair of spaced sections 66. One of the spaced sections 66 adhesively engages the back side 24 such that the clip 64 is retained on the back side 24. The clip 64 may engage the inside surface 16 such that the housing 20 is removably retained on the outer wall 14 of the bag 12.

In use, the attachment 54 is positioned to engage the inside surface 16 of the bag 12. The switch 48 is manipulated to actuate each of the first light emitters 42 and the second light emitter 46 to illuminate the interior of the bag 12. The switch 42 is manipulated to de-actuate each of the first light emitters 42 and the second light emitter 46 when the interior of the bag 12 no longer needs to be illuminated.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lighting system configured to illuminate an interior of a bag, said system comprising:

a bag having an outer wall, said outer wall having an inside surface; and a lighting unit being removably attached to said bag, said lighting unit being positioned on said inside surface of said outer wall, said lighting unit being selectively actuatable to emit light downwardly in said bag with respect to said lighting unit and laterally in said bag with respect to said lighting unit such that said lighting unit illuminates an interior of said bag thereby facilitating contents of said bag to be found in darkness.

2. The system according to claim 1, wherein said lighting unit comprises a housing having a front side, a back side and a peripheral side extending between said front side and said back side, said peripheral side having a top surface, a bottom surface and a first lateral surface.

3. The system according to claim 2, wherein said first lateral surface comprises an alternating sequence of hills and valleys, said hills and valleys being distributed between said top surface and said bottom surface wherein said hills and valleys are configured to enhance a grip of said housing.

4. The system according to claim 2, further comprising a plurality of first light emitters, each of said first light emitters being attached to said housing, each of said first light emitters being spaced apart from each other and distributed along said front side wherein each of said first light emitters emits light laterally in said bag.

5. The system according to claim 2, further comprising a second light emitter, said second light emitter being attached to said housing, said second light emitter being positioned to extend along said bottom surface wherein said second light emitter is emits light downwardly into said bag.

6. The system according to claim 2, further comprising:

a plurality of first light emitters;

a second light emitter; and a switch being coupled to said housing, said switch being positioned on said top surface, said switch being electrically coupled to each of said first light emitters and said second light emitter wherein said switch selectively actuates and de-actuates each of said first light emitters and said second light emitter.

7. The system according to claim 5, wherein a power supply being positioned within said housing, said power supply being electrically coupled to said switch, said power supply comprising at least one battery.

8. The system according to claim 2, wherein an attachment being attached to said housing, said attachment being positioned on said back side, said attachment engaging said inside surface of said outer wall such that said housing is removably retained on said inside surface.

9. A lighting system configured to illuminate an interior of a bag, said system comprising:

a bag having an outer wall, said outer wall having an inside surface;

a lighting unit being removably attached to said bag, said lighting unit being positioned on said inside surface of said outer wall, said lighting unit being selectively actuatable to emit light downwardly in said bag with respect to said lighting unit and laterally in said bag with respect to said lighting unit such that said lighting unit illuminates an interior of said bag thereby facilitating contents of said bag to be found in darkness, said lighting unit comprising:

a housing having a front side, a back side and a peripheral side extending between said front side and said back side, said peripheral side having a top surface, a bottom surface and a first lateral surface, said first lateral surface comprises an alternating sequence of hills and valleys, said hills and valleys being distributed between said top surface and said bottom surface wherein said hills and valleys are configured to enhance a grip of said housing, a plurality of first light emitters, each of said first light emitters being attached to said housing, each of said first light emitters being spaced apart from each other and distributed along said front side wherein each of said first light emitters emits light laterally in said bag, a second light emitter, said second light emitter being attached to said housing, said second light emitter being positioned to extend along said bottom surface wherein said second light emitter is emits light downwardly into said bag, a switch being coupled to said housing, said switch being positioned on said top surface, said switch being electrically coupled to each of said first light emitters and said second light emitter wherein said switch selectively actuates and de-actuates each of said first light emitters and said second light emitter, and a power supply being positioned within said housing, said power supply being electrically coupled to said switch, said power supply comprising at least one battery; and an attachment being attached to said housing, said attachment being positioned on said back side, said attachment engaging said inside surface of said outer wall such that said housing is removably retained on said inside surface.

* * * * *